United States Patent [19]

Stasin

[11] Patent Number: 4,611,924

[45] Date of Patent: Sep. 16, 1986

[54] CONTAINER INCORPORATING AN ALARM

[76] Inventor: Howard R. Stasin, No 1 Heilbron Flats, Sophia St., Oranjezicht, Cape Province, South Africa

[21] Appl. No.: 618,202

[22] Filed: Jun. 7, 1984

[30] Foreign Application Priority Data

Jun. 8, 1983 [ZA] South Africa ..... 83/4191

[51] Int. Cl.[4] ..... G04B 47/00; G04F 8/00

[52] U.S. Cl. ..... 368/10; 368/109; 368/278; 221/2

[58] Field of Search ..... 368/10, 89, 107–113, 368/276–278; 221/2, 15, 3; 222/638, 644

[56] References Cited

U.S. PATENT DOCUMENTS 4,223,801 9/1980 Carlson ..... 368/10
4,258,354 3/1981 Carmon et al. ..... 368/10
4,361,408 11/1982 Wirtschafter ..... 368/10
4,367,955 1/1983 Ballew ..... 368/10
4,382,688 5/1983 Machamer ..... 368/10

*Primary Examiner*—Vit W. Miska
*Attorney, Agent, or Firm*—Ladas & Parry

[57] ABSTRACT

A container particularly for medicaments is disclosed. The container includes an alarm which is actuated at a predetermined time each day if the container is not opened during a predetermined time interval prior to said predetermined time. The time interval can be twenty four hours. If the container is opened during said time interval, the alarm is disabled and only actuated at the end of the succeeding time interval. If the alarm is actuated because the container has not been opened during the preceding time interval, opening of the container disables the alarm.

3 Claims, 3 Drawing Figures

CONTAINER INCORPORATING AN ALARM

BACKGROUND OF THE INVENTION

Containers for medications are known which have built in alarms to warn the user that he or she has failed to take the medication at the correct time. Such a container is shown in U.S. Pat. No. 4,382,688. The alarm of this container is switched-off when the container is opened. The container can also have a separate termination button which the user can employ if he or she decides not to open the container and take the medication.

OBJECT OF THE INVENTION

The main object of the present invention is to provide a medication container the alarm of which can be disabled prior to the set actuation time.

BRIEF DESCRIPTION OF THE INVENTION

According to one aspect of the present invention there is provided a container comprising a first part and a second part, the parts being movable with respect to one another between a position in which the container is closed and a position in which the container is open, switch means which are actuated when the container is opened, and an alarm for warning that the container has not been opened during a predetermined interval of time, said alarm being connected to said switch means in such manner that the state of the alarm is altered when the container is opened during said predetermined interval of time so that said alarm is not actuated at the end of said predetermined interval of time.

Said alarm can be audible and/or visual.

The alarm can be such that while it is not actuated at the end of said predetermined interval once said switch means has been actuated during said predetermined interval, it is actuated at the end of the following predetermined interval if the switch means is not actuated again during said following interval.

The predetermined interval can be twenty four hours.

The alarm can incorporate a clock, preferably a clock with a digital display.

The container can include means for enabling the time at which said predetermined interval expires to be varied.

The container can have a base and a hinged lid which constitute said first and second parts. Alternatively, said parts can be telescope with respect to one another. In this form the switch means and the alarm can be incorporated into the inner telescopic part, the switch means being actuated as the first part is slid out of the second part.

According to a further aspect of the present invention there is provided a container comprising a first part and a second part, the parts being movable with respect to one another between a position in which the container is closed and a position in which the container is open, switch means which are actuated when the container is opened, an alarm for warning that the container has not been opened during a predetermined interval of time, electronic timing means, manually operable control means for the timing means, the control and timing means being settable so that the alarm is activated at the end of said predetermined interval, and electronic resetting means for de-activating the alarm so that it is not actuated at the end of said predetermined interval of time if the container is opened during said interval but is only activated at the end of the succeeding time interval.

BRIEF DESCRIPTION OF THE DRAWINGS

For a better understanding of the present invention, and to show how the same may be carried into effect, reference will now be made, by way of example, to the accompanying drawing in which.

DETAILED DESCRIPTION OF THE DRAWINGS

Figure 1:
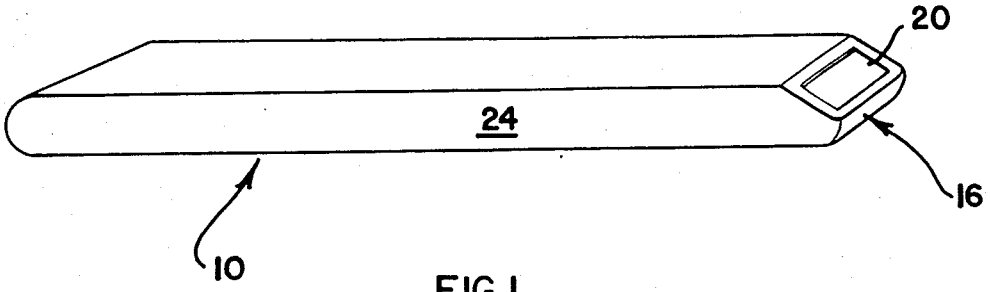
FIG. 1 is a pictorial view of a container in accordance with the present invention.
Figure 2:
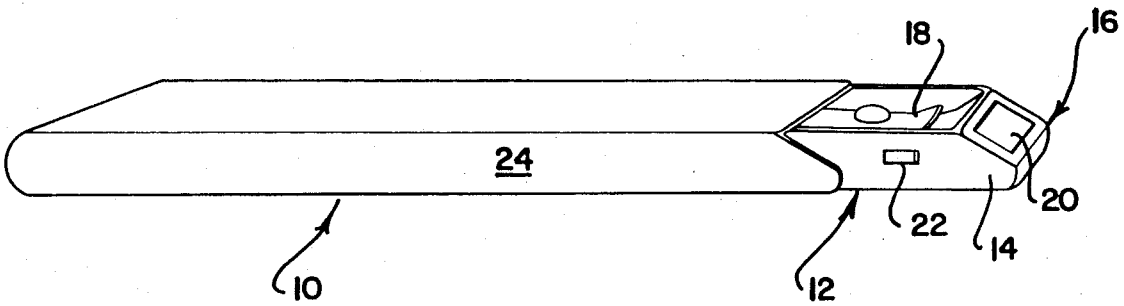
FIG. 2 is a pictorial view of the container of FIG. 1 in a partially open condition.

The container illustrated in FIGS. 1 and 2 comprises an outer part 10 which is in the form of an elongate sleeve. The sleeve is open at one end and closed at the other. The container further comprises an inner part 12 which is dimensioned so as to be capable of sliding telescopically into and out of the outer part 10 through the open end thereof. The inner part 12 is in the form of an upwardly open tray and has side walls 14, a base wall which is not visible in the drawings, and an end wall structure 16. Pills, tablets and the like 18 are received in the upwardly open tray.

Built into the wall structure 16 is an alarm which incorporates a clock 20 having a digital display. A switch 22 is provided in conjunction with one of the side walls 14. By way of example, there can be an aperture in the side wall 14 and an operating member of the switch can protrude through this aperture. While the container is closed, one of the side walls 24 of the outer part 10 holds the switch 22 in one condition. When the container is opened by sliding the inner part 12 out of the outer part 10, the switch 22 moves to its other condition under the action of a suitable form of spring biassing.

The alarm is such that, unless its state is changed by actuation of the switch 22, it will be actuated once every 24 hours. Suitable controls (not shown in FIGS. 1 and 2) are provided to enable the user to set the alarm so that it is actuated at a predetermined time during each 24 hour interval. For example, the alarm might be set so that it is actuated at 2 am. When the container is opened, the switch 22 is actuated and this resets the alarm. The effect of this is that the alarm will not be actuated when the time next reaches 2 am. However, the alarm will be actuated 24 hours after that unless the container is re-opened and the switch 22 actuated again.

The main function of the container is to receive pills or tablets that must be taken once per day. Birth control pills are an example of the type of medicament that it is envisaged will be stored within the container. If the woman does not open the container to take out a pill in the internal of 24 hours preceding, say, 2 am, then the alarm will sound at 2 am to warn her of this fact. If, however, prior to 2 am she opens the container then the state of the alarm will be changed. Thus it will not be actuated at the following 2 am but will only be actuated again 24 hours after that.

Figure 3:
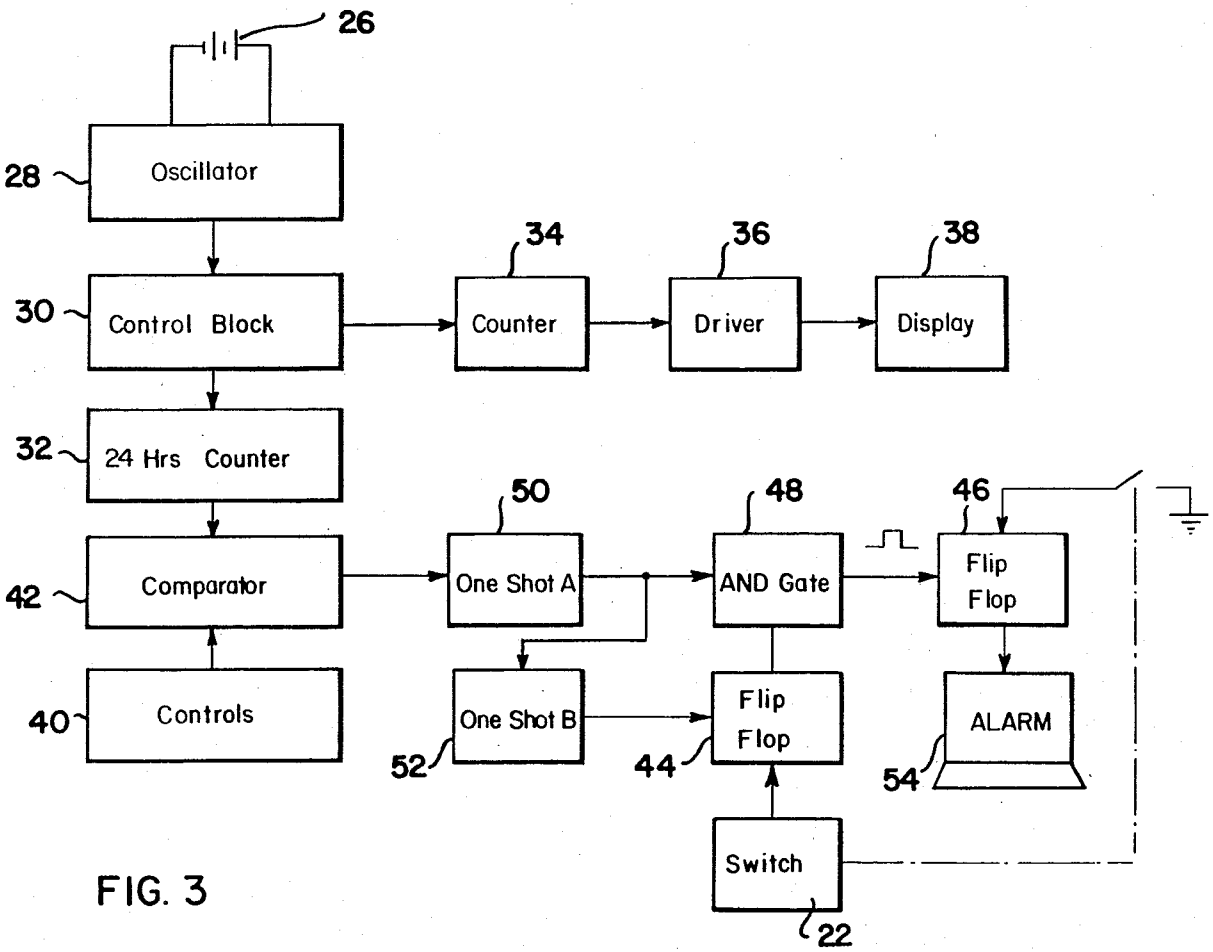
FIG. 3 is a block diagram of the electronic circuit of the container.

Turning now to FIG. 3, reference numeral 26 designates a power source which can be in the form of a battery located in a battery box of the container. The oscillator 28 produces square pulses which are fed to the control block 30. The block 30 includes a frequency divider which divides the frequency received from the oscillator and produces output signals for a 24 hour counter 32 and a further counter 34. The counter 34 is connected via a driver 36 to a digital display 38.

The control designated 40 is set manually to the time at which it is desired the alarm signal be given. A signal from the control 40 is fed to a comparator 42 which also receives a signal from the counter 32.

The switch 22 is connected to a first flip-flop 44 and also to a second flip-flop 46. The connection to the second flip-flop 46 is shown as a normally open switch which, when closed, earths the flip-flop 46. An AND gate 48 is connected between a first monostable multi vibrator 50 (also referred to as a 'one-shot') and the flip-flop 46. A second monostable multi vibrator 52 is connected between the multi vibrator 50 and the flip-flop 44. The alarm designated 54 is connected to the flip-flop 46. The comparator 42 is connected to the multi vibrator 50.

The comparator 42 compares the signal from the counter 32 with the signal produced by the control 40. When the time signal received from the counter 32 matches that received from the control 40, a pulse is fed to the monostable multi vibrator 50. The resultant output from the multi vibrator 50 is in the form of a square pulse which is fed to the gate 48 and to the monostable multi vibrator 52.

If the container has been opened during the preceding predetermined time interval, the voltage level at the output of the flip-flop 44 holds the gate 48 in a blocked condition. No output signal thus reaches the flip-flop 46 and the alarm 54 is not actuated.

The output from the monostable multi vibrator 50 also reaches the multi vibrator 52. The multi vibrator 52 is activated by the trailing edge of the pulse which reaches it. A reset pulse for the flip-flop 44 is thus produced and the voltage lever at the output of the flip-flop unblocks the gate 48.

If the container has not been opened during the preceding predetermined time period, then the voltage level at the output of the flip-flop 44 does not change and its output is such that the gate 48 remains unblocked. The pulse from the monostable multi vibrator 50 reaches the flip-flop 46 and the alarm 54 is thus actuated.

When the container is opened, while the alarm is in operation, the flip-flop 46 is re-set to its other condition by closing of the second contacts of the switch 22 and the alarm is switched off.

The container can take forms other than that illustrated. For example, it can be in the form of an upwardly open box-like base with a hinged lid. The switch can, in this form, be built into the base and actuated when the lid is swung to its open position. The digital display can be in a side wall of the base.

In another form the container incorporates an alarm clock of generally conventional form. Thus the clock has means for setting it so that it will sound at the desired time, and further means such as a button for switching the alarm off. The container and clock are, however, linked so that the alarm cannot be switched off by means of the button unless the container has been opened during a predetermined period preceding the time for which the alarm has been set. Only opening of the container switches the alarm off in these circumstances.

In another form the alarm can be such that an attempt to set the alarm causes it to sound unless the container has been opened during a predetermined period prior to the attempt to set the alarm.

I claim:

1. A container comprising a first part and a second part, the parts being movable with respect to one another between a position in which the container is closed and a position in which the container is open, switch means which are actuated by relative movement between the container parts when the container is opened, and an alarm for warning that the container has not been opened during a predetermined interval of time, said alarm being connected to said switch means in such manner that the state of the alarm is altered when the container is opened during said predetermined interval of time so that said alarm is not actuated at the end of said predetermined interval of time.

2. A container according to claim 1, wherein the alarm is such that while it is not actuated at the end of said predetermined interval once said switch means has been actuated during said predetermined interval, it is actuated at the end of the following predetermined interval if the switch means is not actuated again during said following interval.

3. A container comprising a first part and a second part, the parts being movable with respect to one another between a position in which the container is closed and a position in which the container is open, switch means which are actuated by relative movement between the container parts when the container is opened, an alarm for warning that the container has not been opened during a predetermined interval of time, electronic timing means, manually operable control means for the timing means, the control and timing means being settable so that the alarm is activated at the end of said predetermined interval, and electronic resetting means for de-activating the alarm so that it is not actuated at the end of said predetermined interval of time if the container is opened during said interval but is only activated at the end of the succeeding time interval.

* * * * *